United States Patent [19]

Liebe et al.

[11] Patent Number: 4,932,424

[45] Date of Patent: Jun. 12, 1990

[54] APPARATUS FOR CONDITIONING TOBACCO AND LIKE FIBROUS MATERIALS

[75] Inventors: Reinhard Liebe, Hamburg; Waldemar Wochnowski, Hamburg-Meiendorf; Enno Freesemann, Aumühle, all of Fed. Rep. of Germany

[73] Assignee: Körber AG, Hamburg, Fed. Rep. of Germany

[21] Appl. No.: 184,792

[22] Filed: Apr. 22, 1988

[30] Foreign Application Priority Data

Apr. 24, 1987 [DE] Fed. Rep. of Germany ..... 3713763

[51] Int. Cl.[5] ..... A24B 3/12; A24B 3/18

[52] U.S. Cl. ..... 131/304; 131/305; 34/46; 34/217; 34/218

[58] Field of Search ..... 131/303, 304; 34/218, 34/217, 225, 46, 10

[56] References Cited

U.S. PATENT DOCUMENTS

| | | | |
|---|---|---|---|
| Re. 31,816 | 1/1985 | Wochnowski | 131/304 |
| 3,877,469 | 4/1975 | Wochnowski et al. | 131/303 |
| 3,881,498 | 5/1975 | Wochnowski et al. | 131/303 |
| 3,957,063 | 5/1976 | Wochnowski | 131/303 |
| 3,974,839 | 8/1976 | Wochnowski et al. | 131/304 |
| 4,004,594 | 1/1977 | Wochnowski et al. | 131/303 |
| 4,116,203 | 9/1978 | Wochnowski et al. | 131/303 |
| 4,143,471 | 3/1979 | Wochnowski et al. | 131/303 |
| 4,195,647 | 4/1980 | Wochnowski et al. | 131/303 |
| 4,298,012 | 11/1981 | Wochnowski | 131/303 |
| 4,346,524 | 8/1982 | Wochnowski et al. | 131/303 |
| 4,452,256 | 6/1984 | Wochnowski et al. | 131/303 |

FOREIGN PATENT DOCUMENTS

| | | | |
|---|---|---|---|
| 0537594 | 10/1931 | Fed. Rep. of Germany | 34/225 |
| 2675373 | 1/1982 | United Kingdom . | |
| 2138666 | 10/1984 | United Kingdom . | |

*Primary Examiner*—V. Millin

*Attorney, Agent, or Firm*—Peter K. Kontler

[57] ABSTRACT

Apparatus for puffing, drying or moisturizing tobacco has a conveyor defining an elongated channel with an inlet and an outlet for particles of tobacco. The conveyor is vibrated so that the particles advance toward the outlet, and the bottom wall of the conveyor has orifices which serve to discharge jets of hot air or steam into the channel in such orientation that the jets of admitted fluid medium are inclined to each other, to the direction of advancement of tobacco particles and/or to the vertical. The orifices receive fluid from a chamber which is provided beneath the bottom wall and is connected to a source of steam or hot air. An advantage of the apparatus is that the exchange of heat and/or moisture between tobacco particles and the fluid is highly satisfactory, as well as that substances which are propelled by jets of fluid toward the top wall of the conveyor are more or less uniformly distributed along the entire top wall so that they are less likely to gather into large cakes which could become separated from the top wall to enter the flow of tobacco particles and to advance therewith to the next processing station. The bottom wall of the conveyor can have an undulate shape with the orifices provided in the flanks of hills which alternate with the valleys of such bottom wall.

18 Claims, 2 Drawing Sheets

APPARATUS FOR CONDITIONING TOBACCO AND LIKE FIBROUS MATERIALS

CROSS-REFERENCE TO RELATED CASES

Apparatus which are similar to the apparatus of the present invention are disclosed, among others, in commonly owned U.S. Pat. No. 3,881,498 to Wochnowski, U.S. Pat. No. 3,957,063 to Wochnowski, U.S. Pat. No. 3,974,839 to Wochnowski et al., U.S. Pat. No. 4,004,594 to Wochnowski et al., U.S. Pat. No. 4,116,203 to Wochnowski, U.S. Pat. No. 4,143,471 to Wochnowski et al., U.S. Pat. No. 4,195,647 to Wochnowski et al., U.S. Pat. No. 4,346,524 to Wochnowski et al. and U.S. Pat. No. 4,452,256 to Wochnowski et al., as well as in numerous foreign patents and patent applications of the assignee of the present application.

BACKGROUND OF THE INVENTION

The invention relates to improvements in apparatus for conditioning fibrous materials, such as fragments of tobacco leaf laminae and/or fragments of tobacco ribs. More particularly, the invention relates to improvements in apparatus of the type wherein fibrous material which is to be puffed, moisturized, dried and/or otherwise conditioned is conveyed along an elongated path which is defined by a vibrating conveyor and wherein the fibrous material is conditioned as a result of contact with a hot fluid medium, particularly steam or a hot gaseous fluid (such as air).

Apparatus of the above outlined character, wherein the fibrous material is treated with steam are disclosed, for example, in published British patent application Ser. No. 21 38 666 and in U.S. Pat. No. 4,298,012 to Wochnowski (this patent was reissued under No. Re. No. 31,816). U.S. Pat. No. 3,877,469 to Wochnowski et al. discloses an apparatus wherein fibrous material is contacted by hot air. Published British patent application Ser. No. 20 75 373 discloses an apparatus wherein fibrous material is contacted with a liquid substance, such as water.

Heretofore known apparatus for the conditioning of tobacco and similar fibrous materials exhibit certain drawbacks, especially as concerns the exchange of heat and/or moisture between fibrous material and the fluid medium which is brought into contact with fibrous material, and also as concerns the deposition of undesirable substances in the conveyor wherein the fibrous material is treated by jets or streams of a hot, wet or dry fluid medium.

OBJECTS AND SUMMARY OF THE INVENTION

An object of the invention is to provide a simple, compact and versatile apparatus which can be used for the conditioning of a variety of fibrous materials, such as comminuted (particularly shredded) fragments of tobacco leaf laminae and/or tobacco ribs, and which can be installed in existing tobacco processing plants as a superior substitute for heretofore known apparatus.

Another object of the invention is to provide an apparatus which exhibits the aforedescribed advantages and can be arrived at as a result of inexpensive but important modifications of existing apparatus.

A further object of the invention is to provide an apparatus wherein undesirable substances are less likely to gather in the conveyor for fibrous material than in heretofore known apparatus.

An additional object of the invention is to provide an apparatus whose conditioning action upon fibrous material is more uniform and faster than that of heretofore known apparatus.

Still another object of the invention is to provide a novel and improved apparatus which can be utilized for puffing, drying, moisturizing and/or analogous treatment of shredded and/or otherwise comminuted tobacco and/or other types of fibrous material for use in the tobacco processing industry.

A further object of the invention is to provide a novel and improved conveyor for use in the above outlined apparatus.

Another object of the invention is to provide a tobacco processing plant which embodies the above outlined apparatus.

An additional object of the invention is to provide a novel and improved method of puffing, drying or moisturizing fibrous materials, such as fragments of tobacco leaf laminae and/or fragments of tobacco ribs.

The invention is embodied in an apparatus for conditioning (such as puffing or increasing or reducing the moisture content of) a fibrous material, particularly tobacco, with a fluid consisting of steam or a hot gas (such as air). The apparatus comprises a conveyor which serves to advance fibrous material in a predetermined direction and has walls defining an elongated substantially closed channel with a material-admitting inlet and a material-discharging outlet. The walls include a bottom wall which is disposed beneath the channel and has fluid-admitting orifices serving to direct into the channel jets or streamlets of fluid in upward directions which are inclined with reference to the vertical. The conveyor further comprises means for agitating the bottom wall (e.g., means for vibrating the walls so as to bring about a flow of fibrous material from the inlet to the outlet of the channel), and the apparatus further comprises means for supplying fluid to the orifices in the bottom wall of the conveyor.

Each upward direction has a vertical component, and at least some of the upward directions have a second component substantially transversely of the predetermined direction, particularly at right angles to the predetermined direction. The second components and the respective vertical components preferably make angles of at least 3 degrees, most preferably angles of 10–45 degrees.

The upward directions can include a plurality of different upward directions, i.e., the jets of steam or hot gas can be inclined relative to each other. At least some of the upward directions can be normal to the predetermined direction. The arrangement may be such that neighboring orifices in the bottom wall admit into the channel jets in different directions, particularly at right angles to the predetermined direction. This can be achieved by imparting to a portion of or to the entire bottom wall an undulate or substantially undulate shape. Thus, the bottom wall can be provided with hills and the orifices can be provided in such hills so that at least some orifices are inclined relative to each other.

The fluid supplying means and the bottom wall can cooperate to form a fluidized bed or flow of fibrous material in the channel. To this end, the fluid supplying means can comprise a source of hot air or another suitable gas.

It is also possible to design the bottom wall in such a way that at least some of the orifices discharge jets of fluid in upward directions at least some of which have components in the predetermined direction.

If the fluid supplying means includes a source of steam, the fluid supplying means can cooperate with the bottom wall of the conveyor to admit into the channel steam at a rate which is required to bring about a puffing (volume increasing) action during advancement of fibrous material from the inlet to the outlet of the channel.

Hot air or another hot gas can be used to reduce the moisture content of fibrous material in the channel. Such drying action is normally necessary during transport of tobacco from a shredding machine to the distributor (also called hopper) of a cigarette making machine.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
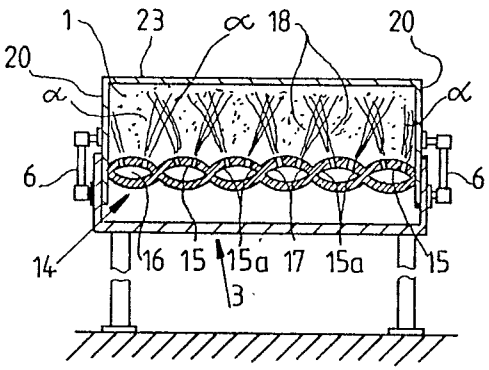
FIG. 2 is an enlarged transverse vertical sectional view as seen in the direction of arrows from the line II—II of FIG. 1.
Figure 1:
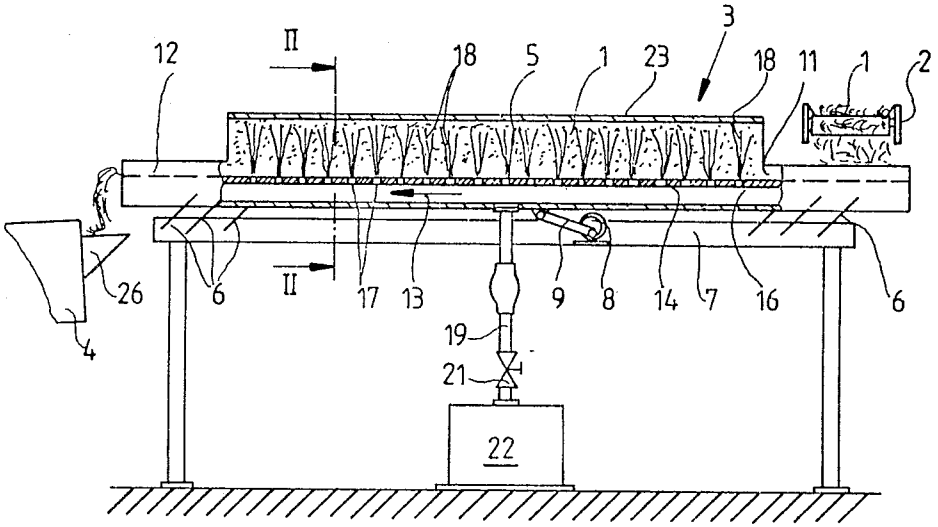
FIG. 1 is a partly elevational and partly longitudinal vertical sectional view of a tobacco conditioning apparatus which operates with steam.

FIGS. 1 and 2 show an apparatus which is used for moisturizing and heating particles 1 of tobacco, e.g., shredded tobacco which is obtained as a result of comminution of tobacco leaf laminae and/or tobacco ribs. Fibrous material is supplied by an endless belt conveyor 2 which, in turn, receives the material from a suitable shredding or other comminuting machine, not shown. Such machines are produced by the assignee of the present application. The conveyor 2 delivers successive increments of a continuous or substantially continuous stream or flow of tobacco particles 1 into the inlet 11 of a second or conditioning conveyor 3 which defines an elongated substantially horizontal path for the flow of tobacco particles from the inlet 11 toward and beyond the outlet 12 for tobacco particles in a channel 5 bounded by a novel bottom wall 14, a top wall 23 and two sidewalls 20. The channel 5 is substantially sealed from the surrounding atmosphere save in the region of the inlet 11 and outlet 12 of the conveyor 3. The outlet 12 discharges successive increments of the stream or flow of conditioned tobacco particles 1 into the inlet 26 of a dryer 4, e.g., of the type wherein the particles are dried while advancing in a stream of relatively dry heat exchange fluid so that the particles form a fluidized bed of fibrous material. Reference may be had, for example, to the aforementioned U.S. Pat. No. 3,877,469 and U.S. Pat. No. 4,143,471 to Wochnowski et al.

The means for vibrating or similarly agitating the walls 14, 20 and 23 of the conveyor 3 includes two sets of leaf springs 6 which connect the sidewalls 20 to a stationary frame 7, a power-driven rotary eccentric 8 which is mounted on the frame 7, and a link 9 which couples the bottom wall 14 to the eccentric. The prime mover for the eccentric 8 is or can constitute an electric motor. The nature of vibratory movements which are performed by the walls 14, 20 and 23 of the conveyor 3 in response to rotation of the eccentric 8 is such that the particles 1 of tobacco advance (at an optimum speed) in the direction of arrow 13, i.e., from the inlet 11 toward and beyond the outlet 12.

The bottom wall 14 of the conveyor 3 defines a composite chamber 16 for admission of steam and includes an undulate top portion 15 with neighboring hills 15*a* and valleys. The flanks of the hills 15*a* have orifices 17 which admit into the channel 5 jets or streamlets 18 of steam in such orientation that the jets are inclined to the vertical and to the direction (arrow 13) of advancement of tobacco particles 1 toward the outlet 12. The composite chamber 16 receives steam from a suitable source 22 by way of a steam supplying conduit 19 which contains a flow regulating valve 21. The orifices 17 can constitute simple round bores or holes which are drilled into or otherwise formed in the hills 15*a* of top portion 15 of the bottom wall 14.

The inclination of the jets 18 to the vertical is preferably not less than 3 degrees, most preferably 10–45 degrees. However, it is also possible to select the orientation of orifices 17 in such a way that the inclination of jets 18 relative to the vertical is between 3 and 10 degrees or even in excess (if necessary well in excess) of 45 degrees. This can depend on the rate of flow of fibrous material in the channel, on the rate of deposition of undesirable substances at the underside of the top wall 23 and/or other parameters. Each jet 18 can have a component of flow in or even counter to the direction of the arrow 13, a vertical component of flow and a component of flow transversely of (particularly at right angles to) the direction which is indicated by the arrow 13.

As can be readily seen in FIG. 2, the jets 18 are also inclined relative to each other so that they intersect each other in regions at a level below the top wall 23 of the conveyor 3. This also contributes to an intensive, predictable and highly satisfactory conditioning of tobacco particles 1 on their way from the inlet 11 toward the outlet 12. For example, pairs of neighboring jets 18 (in a plane extending at right angles to the direction which is indicated by the arrow 13) can be inclined relative to each other in such plane to meet in a region approximately midway between the undulate top portion 15 of the bottom wall 14 and the top wall 23 of the conveyor 3. It has been found that such orientation of the axes of orifices 17 in the flanks of hills 15*a* forming part of the top portion 15 of bottom wall 14 ensures a highly satisfactory exchange of heat and/or moisture between the particles 1 and steam which flows from the composite chamber 16 into the channel 5 to interact with tobacco, e.g., by heating and/or by moisturizing the particles 1. If the conditioning medium in the source 22 is superheated steam, such medium can be used to reduce the moisture content of the particles 1. The jets 18 cooperate with the vibrating walls 15, 20, 23 of the conveyor 3 to agitate the particles 1 and to thus even further enhance the drying, moisturizing and/or other conditioning action upon the particles. The mode of operation can be such that the bottom wall 14 cooperates with the jets 18 of steam to convert the particles 1 in the channel 5 into a fluidized mass which floats on and in steam on its way toward the outlet 12. Such mode of transporting the particles 1 toward the dryer 4 has been found to even further enhance the conditioning action of steam and renders it possible to employ a relatively short and compact conveyor 3.

When the jets 18 of steam impinge upon the particles 1 in the channel 5, they entrain certain substances from such particles and cause the deposition of such substances at the underside of the top wall 23. It has been found that, since the jets 18 of steam issuing from the chamber 16 are not exactly vertical (note the angles alpha), the distribution of substances (such as oils) which are entrained from the particles 1 by ascending jets 18 of steam and deposit at the underside of the top wall 23 is at least substantially uniform (much more uniform than if the jets 18 were to be oriented exactly vertically upwardly). Therefore, it is less likely that the substances which deposit at the underside of the top wall 23 would gather into cakes or layers of pronounced thickness which would tend to peel off the underside of the top wall 23, to descend into the advancing mass of fibrous material in the channel 5, and to be admitted into the next processing unit, such as the dryer 4. The presence of substantial quantities of substances which have descended from the top wall 23 in the conditioned fibrous material is highly undesirable. The accumulations at the underside of the top wall 23 can be readily removed during periodic cleaning of the surfaces surrounding the channel 5.

As mentioned above, the dryer 4 whose inlet 26 receives conditioned particles 1 from the outlet 12 of the conveyor 3 may be of the type disclosed in U.S. Pat. No. 3,877,469 to Wochnowski et al.

The apparatus of FIGS. 1 and 2 is especially suited for heating and moisturizing as well as for simultaneously puffing tobacco particles. Such puffing is desirable because it increases the volume of individual particles. Reference may be had to the aforementioned U.S. Pat. No. 4,298,012 which deals with a method of increasing the specific volume of tobacco ribs.

Steam which is supplied by the conduit 19 can be used to moisturize and simultaneously heat the particles 1. If the steam which is admitted via orifices 17 is in a state of hygroscopic equilibrium with the particles 1, the particles are subjected to a mere heating action. As already mentioned above, the particles can be dried if the source 22 contains a supply of superheated steam.

Figure 4:
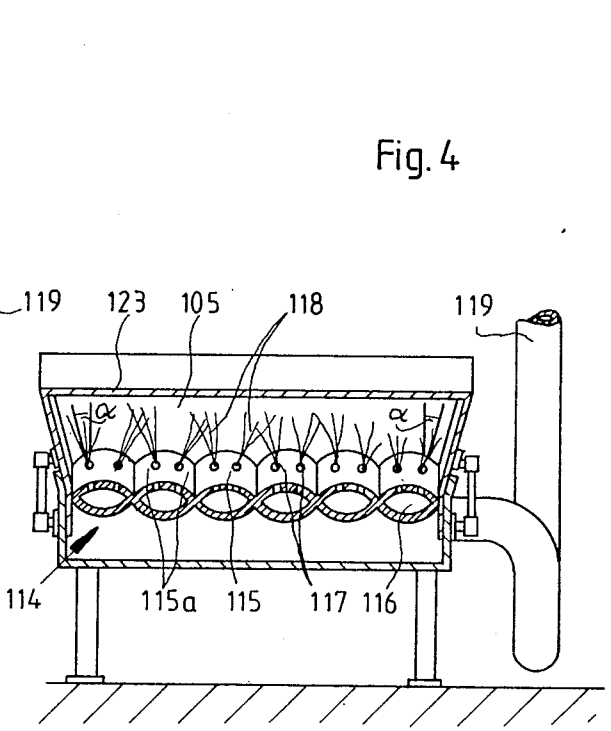
FIG. 4 is a sectional view as seen in the direction of arrows from the line IV—IV in FIG. 3.
Figure 3:
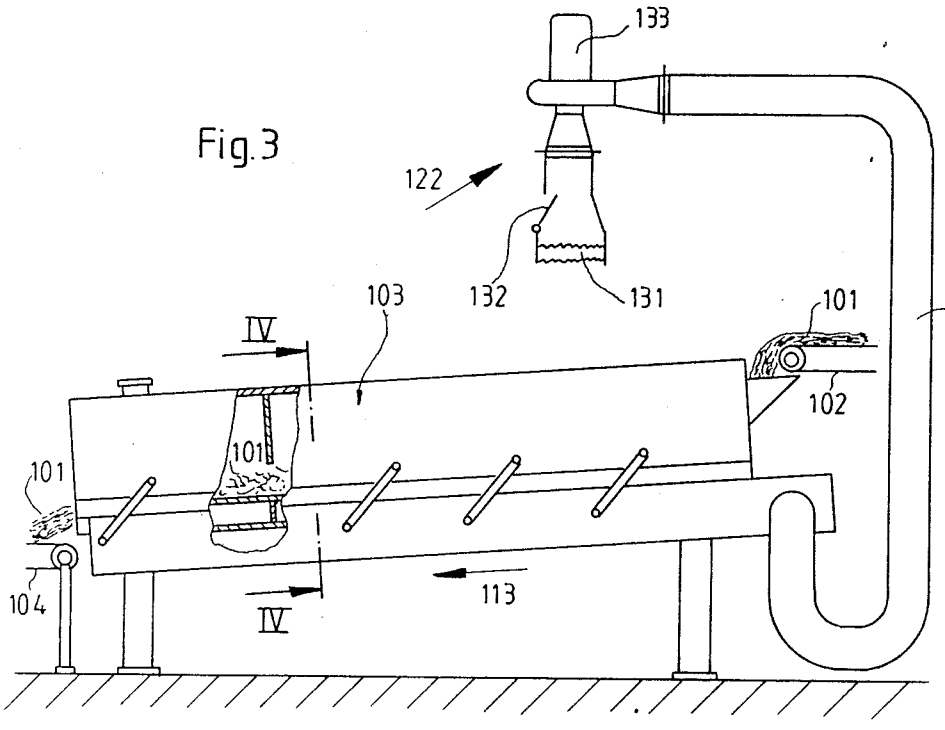
FIG. 3 is an elevational view of a tobacco drying apparatus which operates with hot air.

FIGS. 3 and 4 show a modified apparatus wherein a conveyor 103 (corresponding substantially to the conveyor 3 of FIGS. 1–2) receives a continuous or discontinuous stream of tobacco particles 101 from an endless belt conveyor 102 and delivers conditioned particles 101 to a further endless belt conveyor 104. The particles 101 are conditioned as a result of intimate and repeated contact with a hot gaseous fluid, such as air. The means 122 for supplying hot air to the chamber 116 in the bottom wall 114 of the conveyor 103 comprises a motor-driven fan 133 which draws cool atmospheric air past an electric resistance heater 131. A pivotable flap 132 is provided downstream of the heater 131 to admit unheated atmospheric air at a variable rate so as to ensure that the temperature of hot air flowing in a conduit 119 toward and into the chamber 116 is maintained within an optimum range which is necessary for predictable drying of the particles 101. The bottom wall 114 and other walls of the conveyor 103 slope downwardly in a direction from the conveyor 102 toward the conveyor 104. The inclination of orifices 117 in the hills **115*a* of the top portion 115 of bottom wall 114 is or can be the same as described for the orifices 17 in the conveyor 3 of FIGS. 1 and 2, i.e., jets 118 of hot gaseous fluid which issue from the chamber 116 to condition the fibrous material 101 in the channel 105 of the conveyor 103 are inclined to the vertical and are also inclined relative to neighboring jets 118 in order to ensure that such jets cross each other at a level below the top wall 123 of the conveyor 103. At least some of the jets 118 can be inclined forwardly and upwardly or rearwardly and upwardly so as to have components of flow in planes extending at right angles to the direction (arrow 113) of advancement of fibrous material 101 toward the conveyor 104 as well as in or counter to such direction. The angles alpha indicate the extent of inclination of jets 118 with reference to the vertical in planes extending transversely of, especially at right angles to, the direction of arrow 113**.

The apparatus of FIGS. 3 and 4 can be used to transport the particles 101 in the channel 105 in the form of a fluidized mass. This is desirable and advantageous because it promotes the exchange of heat between the particles 101 and the jets 118 of hot fluid issuing from the chamber 116 and flowing into the channel 105. The manner in which the angular position of the flap 132 can be changed in order to influence the temperature of hot air flowing in the conduit 119 is or can be the same as disclosed in U.S. Pat. No. 3,877,469.

The apparatus of FIGS. 3–4 can be used with particular advantage for drying the particles 101 of shredded or otherwise comminuted tobacco.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for conditioning a fibrous material, particularly tobacco, with a fluid consisting of steam or hot gas, comprising a conveyor arranged to advance fibrous material in a predetermined direction and having walls defining an elongated substantially closed channel having a material-admitting inlet and a material-discharging outlet, said walls including a bottom wall disposed beneath said channel and having fluid-admitting orifices in an orientation such as to direct into said channel jets of fluid in upward directions which, as a result of the orientation of said orifices, are inclined with reference to the vertical and at least some of said upward directions have a horizontal component substantially transversely of said predetermined direction, said conveyor further having means for agitating said bottom wall; and means for supplying fluid to said orifices.

2. The apparatus of claim 1, wherein each of said upward directions has a substantially vertical component.

3. The apparatus of claim 2, wherein said transverse components and the respective vertical components make angles of at least 3 degrees.

4. The apparatus of claim 3, wherein each of said angles is between 10 and 45 degrees.

5. The apparatus of claim 1, wherein said component is normal to said predetermined direction.

6. The apparatus of claim 1, wherein said upward directions include a plurality of different directions.

7. The apparatus of claim 6, wherein at least some of said upward directions are normal to said predetermined direction.

8. The apparatus of claim 1, wherein at least a portion of said bottom wall has an undulate shape.

9. The apparatus of claim 1, wherein said supplying means includes a source of hot air.

10. The apparatus of claim 1, wherein said fluid supplying means and said bottom wall cooperate to form a fluidized bed of fibrous material in said channel.

11. The apparatus of claim 1, wherein at least some of said upward directions have components in said predetermined direction.

12. The apparatus of claim 1, wherein said supplying means includes a source of steam.

13. The apparatus of claim 1, wherein said supplying means and said bottom wall cooperate to admit fluid at a rate at which the fibrous material is puffed during advancement from said inlet to said outlet.

14. The apparatus of claim 1, wherein said fluid supplying means includes a source of hot gas.

15. The apparatus of claim 1 for conditioning a moisture-containing fibrous material, wherein said fluid supplying means comprises a source of gaseous fluid which reduces the moisture content of fibrous material in said channel.

16. Apparatus for conditioning a fibrous material, particularly tobacco, with a fluid consisting of steam or hot gas, comprising a conveyor arranged to advance fibrous material in a predetermined direction and having walls defining an elongated substantially closed channel having a material-admitting inlet and a material-discharging outlet, said walls including a bottom wall disposed beneath said channel and having fluid-admitting orifices arranged to direct into said channel jets of fluid in upward directions which are inclined with reference to the vertical, said orifices including neighboring orifices arranged to admit into said channel jets in different directions, said conveyor further having means for agitating said bottom wall; and means for supplying fluid to said orifices.

17. The apparatus of claim 16, wherein at least some of said different directions are normal to said predetermined direction.

18. Apparatus for conditioning a fibrous material, particularly tobacco, with a fluid consisting of steam or hot gas, comprising a conveyor arranged to advance fibrous material in a predetermined direction and having walls defining an elongated substantially closed channel having a material-admitting inlet and a material-discharging outlet, said walls including a bottom wall disposed beneath said channel and having fluid-admitting orifices arranged to direct into said channel jets of fluid in upward directions which are inclined with reference to the vertical, at least a portion of said bottom wall having an undulate shape and including hills, said orifices being provided in said hills and at least some of the jets issuing from said orifices being inclined relative to each other, said conveyor further having means for agitating said bottom wall; and means for supplying fluid to said orifices.

* * * * *